United States Patent [19]

Richmond et al.

[11] 4,229,148

[45] Oct. 21, 1980

[54] FUEL INJECTION PUMP

[75] Inventors: James A. Richmond, Monson; Christopher A. Parent, Holyoke, both of Mass.

[73] Assignee: Ambac Industries, Incorporated, Springfield, Mass.

[21] Appl. No.: 972,516

[22] Filed: Dec. 22, 1978

[51] Int. Cl.[3] ..... F02M 41/12

[52] U.S. Cl. ..... 417/485; 417/494; 417/500; 123/496; 123/495

[58] Field of Search ..... 417/289, 500, 485, 494; 123/139 AD, 139 BD, 139 AT

[56] References Cited

U.S. PATENT DOCUMENTS

| | | | |
|---|---|---|---|
| 3,023,705 | 3/1962 | Heiser | 123/139 BD |
| 3,320,892 | 5/1967 | Wolff | 417/493 |
| 3,348,488 | 10/1967 | Wolff | 417/485 |
| 3,818,882 | 6/1974 | Leonov et al. | 123/139 AT |
| 3,908,619 | 9/1975 | Bittelmeyer | 123/139 BD |
| 3,910,724 | 10/1975 | Okamoto | 417/500 X |

*Primary Examiner*—Leonard E. Smith
*Attorney, Agent, or Firm*—Richard D. Weber

[57] ABSTRACT

A single plunger distributor type fuel injection pump for multi-cylinder internal combustion engines having improved features for preventing cavitation in the fuel distribution passages upon fuel cutoff and for providing a uniform residual fuel pressure in the idle fuel distribution passages. The pump does not have the usual delivery valve for maintaining a high residual fuel pressure in the distribution passages. Instead, the passages upon injection termination drain into a spill chamber, the pressure within which builds up to resist fuel flow from the passages and minimize cavitation therewithin. The spill chamber pressure is relieved by a bleed passage opening into the low pressure fuel supply chamber. The pressure in the idle fuel distribution passages is maintained at a low predetermined level by connection of the passages to the fuel supply chamber between injection intervals.

8 Claims, 14 Drawing Figures

FUEL INJECTION PUMP

BACKGROUND OF THE INVENTION

The present invention relates generally to fuel injection pumps for internal combustion engines and relates more particularly to single plunger distributor type pumps for multi-cylinder diesel engines.

In the conventional diesel fuel injection pump, the fuel in the fuel distribution passages between the pump plunger and the nozzle valve seat is maintained at a relatively high residual pressure, for example 2,000 psi, by means of one or more check valves known as delivery valves, the purpose of which is to prevent cavitation within the passages when the pressure therewithin is suddenly dropped upon injection cutoff.

The presence of delivery valves in the injection lines is effective to maintain residual line pressure but is disadvantageous for a number of reasons. The presence of the delivery valve increases the dead volume of fuel between the pumping chamber and the injection line which must be pressurized during the plunger injection stroke before the nozzle is opened. The fuel flow rate through the pump passages, delivery lines and nozzle passages is accordingly relatively slow compared to a pump having a smaller dead volume as can be obtained by eliminating the delivery valve. Under peak pressure conditions, the increased flow rate obtainable with a smaller dead volume produces a larger positive reflected pressure wave at the nozzle with a resultant increase in nozzle flow rate. The effective nozzle pressure and hence the flow rate through the nozzle can accordingly be increased without increasing the pumping chamber pressure by reducing the dead fuel volume between the pumping chamber and nozzle valve seat.

The effective fuel pressure at the pump outlet is further increased by elimination of the delivery valve since a substantial pressure drop occurs across the valve. In tests of a typical pump, the pressure drop caused by the delivery valve circuit was found to be on the order of 700 psi.

Still another disadvantage of the conventional delivery valve is its interference with the proper functioning of certain types of leakless nozzles such as that illustrated and described in the present disclosure. In those types of leakless nozzles requiring a relatively low line pressure between injection intervals, some means such as a "leaking" delivery valve or its equivalent must be provided to lower injection line pressure to permit the necessary pressure relief of the nozzle valve spring chamber.

The present pump is eliminating the conventional delivery valve has gained the advantages enumerated above including a higher effective pressure at the nozzle and the ability to utilize the type of leakless nozzle requiring low residual line pressures. The elimination of the delivery valve, however, has raised the problem of cavitation in the fuel passages upon injection termination. During the rapid pressure drop, voids are apt to form which are subsequently collapsed by the reflected high pressure wave from the nozzle with a resultant erosion of the passage walls. It is the function of the present invention as described below to overcome this problem and to minimize cavitation erosion.

DESCRIPTION OF THE PRIOR ART

Single plunger distributor type pumps of the type to which the present invention is directed have been in commercial use for many years. U.S. Pat. No. 2,518,473 shows an early version of this type of pump. Other patents representative of this type of pump include U.S. Pat. No. 3,186,396 issued June 1, 1965, U.S. Pat. No. 3,371,610 issued Mar. 5, 1958, U.S. Pat. No. 3,440,964 issued Apr. 29, 1969, U.S. Pat. No. 3,420,179 issued Jan. 7, 1969, and U.S. Pat. No. 3,689,200 issued Sept. 5, 1972. Each of these patents discloses a single plunger distributor type pump for multi-cylinder engines wherein the pumping plunger by means of passages therein also serves the function of distributing the pumped fuel to a plurality of fuel distribution passages. In each of these pumps, a delivery valve is employed between the pumping chamber and the distribution passages for preventing a drop in the residual line pressure of such a magnitude as to produce cavitation erosion.

A further single plunger distributor type pump of the same general type is shown in U.S. Pat. No. 3,320,892 issued May 23, 1967. The elimination of the usual delivery valve is disclosed in this patent with its attendant benefits. The problem of cavitation upon injection termination is however only partially corrected by the arrangement disclosed providing communication of the fuel distribution lines with the low fuel supply pressure between injections. Although this arrangement may be effective to fill existing voids in the distribution lines prior to the beginning of the next delivery stroke, cavitation erosion upon termination of injection may continue unchecked since the spill of the high pressure lines is directly into the lower pressure fuel supply chamber.

SUMMARY OF THE INVENTION

In the present invention, the pump is of a generally conventional single plunger distributor type, but the conventional delivery valve is eliminated. To prevent the damaging cavitation erosion upon injection termination, the spill from the high pressure passages is directed into a spill chamber separate from the fuel supply chamber and connected therewith only by a restricted passage whereby a pressure buildup occurs in the spill chamber sufficient to slow the flow from the high pressure passages and minimize the formation of cavities therewithin. The distribution passages are subsequently brought into communication with the fuel supply chamber to insure a uniform pressurization of the lines and a predictable fuel injection.

It is accordingly a primary object of the present invention to provide a fuel injection pump of the single plunger distributor type having no delivery valve and having means for preventing cavitation erosion in the fuel distribution passages during injection cutoff.

A further object of the invention is to provide a pump of the type described wherein the means for preventing cavitation erosion comprises a relatively simple and economically manufactured arrangement which can be incorporated in pumps of a conventional type with minimal redesign.

Another object of the invention is to provide a pump of the type described suited for operation with all types of leakless fuel injection nozzles.

A still further object of the invention is to provide a pump of the type described capable of providing higher effective injection pressures at the nozzle without increasing the pressure in the pumping chamber.

Additional objects and advantages of the invention will be more readily apparent from the following description of an embodiment thereof.

DESCRIPTION OF THE PREFERRED EMBODIMENT

Figure 1:
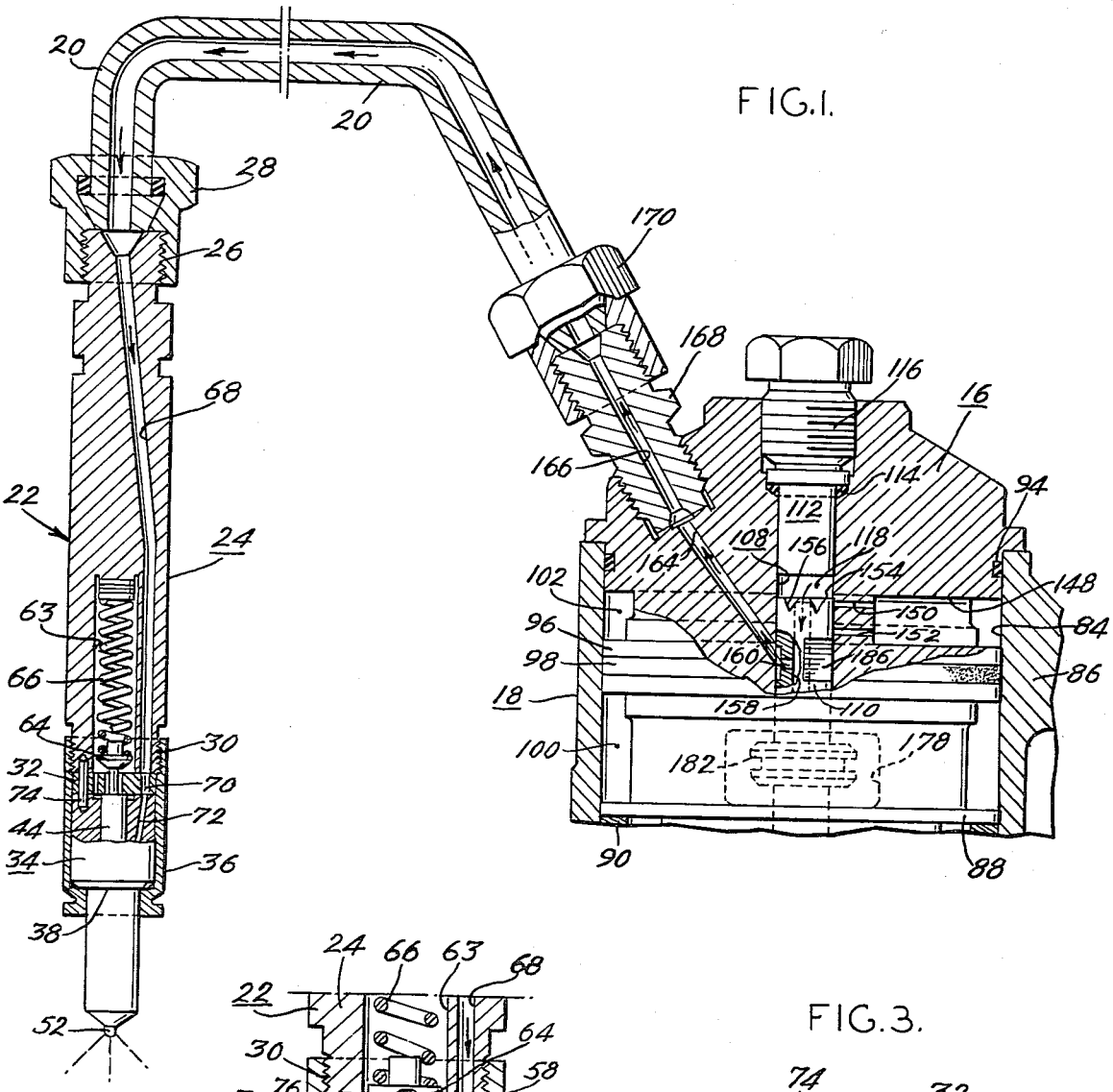
FIG. 1 is an elevational view partly in section showing the hydraulic head of a fuel injection pump in accordance with the present invention having a fuel injection nozzle and holder assembly of a preferred type connected thereto.

With reference to the drawings and particularly FIG. 1 thereof, a hydraulic head 16 of a fuel injection pump 18 is shown connected by injection line 20 to a fuel injection nozzle and holder assembly 22. Although the improvements of the present invention are located within the hydraulic head 16, an understanding of the fuel passages downstream of the hydraulic head is necessary to an appreciation of the inventive features and accordingly the nozzle and holder assembly 22 will be described in detail. The pump 18 is of the single plunger multi-cylinder type and the nozzle and holder assembly 22 and its connecting injection line 20 are but one of a plurality of such assemblies required for an operative system, the number being equal to the number of engine cylinders. As will be presently apparent, the pump 18 shown has been designed for a six cylinder engine although the injection is applicable to pumps having any desired number of fuel outlets.

The nozzle and holder assembly 22 comprises a generally cylindrical nozzle holder 24 having a threaded upper end 26 to which the injection line 20 is secured in sealing relation by means of a nut 28. The holder includes a threaded lower end 30 against which a spacer 32 and nozzle body 34 are secured in coaxially aligned relation by a cap nut 36 which engages a shoulder 38 of the nozzle body.

Figure 2:
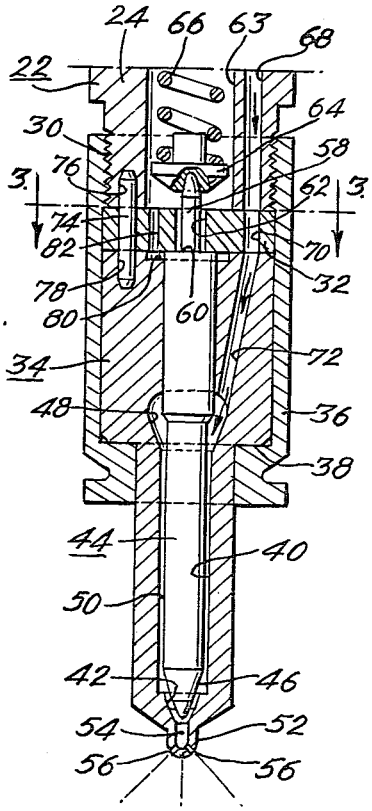
FIG. 2 is an enlarged sectional elevational view of the fuel injection nozzle shown in FIG. 1.

The nozzle body 34 includes a central bore 40 extending through the upper end thereof and which terminates at its lower end adjacent a conical valve seat 42 as shown in FIG. 2. A nozzle valve 44 is slidably disposed within the bore 40 and terminates at its lower end in a conical tip 46 adapted to cooperate with the valve seat 42. The bore 40 includes an annulus 48, and the valve 44 is reduced in diameter within and below the annulus 48 to form an annular passage 50 between the annulus 48 and the valve seat 42. The nozzle body terminates at its lower end in a nozzle tip 52 having a hollow interior chamber 54 known as a sac which communicates with the passage formed between the valve seat and the valve tip when the valve is in the raised position illustrated. Orifices 56 in the nozzle tip 52 permits fuel under pressure to pass from the sac 54 into the combustion chamber of an engine in a predetermined spray pattern.

An extension 58 of the valve 44 extends concentrically from the upper end 60 of the valve, passing through an enlarged bore 62 in the spacer 32 into a spring chamber 63 in the holder 24. The upper end of the valve extension 58 engages a spring guide 64 on which is seated the lower end of a compression coil spring 66 disposed within the spring chamber 63 and bearing at its upper end against the end of the chamber. The spring 66 maintains a closing force on the valve 44, which force must be overcome by the injection pressure of the fuel in order to open the valve as described below.

The fuel passage of the injection line 20 communicates with a passage 68 in the nozzle holder, a passage 70 in the spacer 32, and a passage 72 in the nozzle body opening into the annulus 48. Metered quantities of fuel in the proper timed relation to the engine cycle are pumped by the pump 18 through injection line 20 and passages 68, 70 and 72 into the annulus 48 and thence the annular passage 50 whereupon the pressure acting on the area differential between the upper part of the valve 44 and the non-exposed lower area of the valve seat 42 creates an opening force sufficient to overcome the force of the spring 66 and lift the valve 44 until the upper end 60 of the valve engages the bottom of the spacer 32. The high pressure fuel enters the sac 54 and passes through the small spray orifices 56 whereupon it is atomized for burning within the engine combustion chamber.

Figure 3:
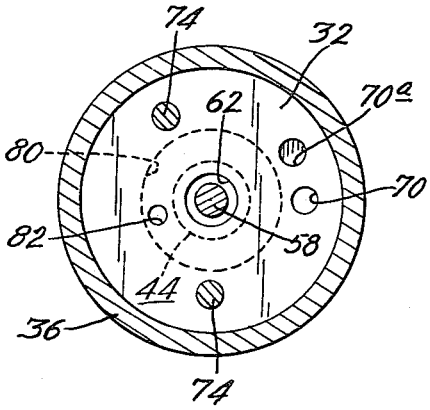
FIG. 3 is an enlarged sectional view taken along line 3—3 of FIG. 2 showing details of the nozzle spacer.
Figure 4:
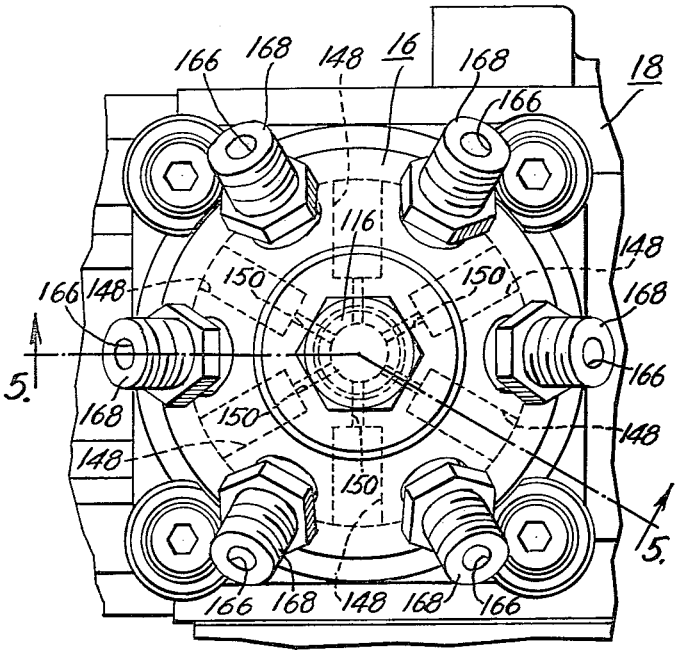
FIG. 4 is a plan view of the fuel injection pump hydraulic head shown in FIG. 1.

As shown in FIGS. 2 and 3, the spacer 32 is maintained in the proper angular relationship with the holder 24 and the nozzle body 34 by dowel pins 74 in the spacer 32 which fit into aligned bores 76 and 78 respectively in the holder 24 and the nozzle body 34. In view of the possibility that the spacer may be assembled upside down, an alternative passage 70*a* is provided in the spacer which in the inverted position of the spacer will connect the passages 68 of the holder and 72 of the valve body.

The illustrated nozzle and holder assembly 22 is of the leakless type, meaning that fuel leakage around the upper end of the valve 44 which passes into the spring chamber 63 is not removed to a sump as in the conventional nozzle. Instead, this fuel is permitted to leak back along the valve during the periods between injection, and the pressure in the injection lines is reduced sufficiently between injections to prevent a pressure buildup in the spring chamber sufficient to prevent the proper opening of the valve. Since the pressure buildup in the spring chamber will effectively augment the force of the spring in closing the valve, it is important that this pressure buildup be uniform in each of the engine nozzles. Since the upper end of the valve 60 bearing against the lower surface of the spacer 32 may cause a sealing of the bore 62 during the injection interval and thus prevent a predictable pressure buildup in the spring chamber 63, means are provided to insure communication between the spring chamber 63 and the upper end of the bore 40 in the event that such a sealing relationship should take place between the upper end of the valve and the lower surface of the spacer. This means comprises a counterbore 80 in the upper end of the bore 40 and a passage 82 in the spacer extending between the counterbore 80 and the spring chamber 63. Should the bore 62 become sealed during the injection interval, the leakage high pressure fuel passing between the valve 44 and bore 40 will pass by means of counterbore 80 and passage 82 into the spring chamber 63. It should be noted that the sectional views of FIGS. 1 and 2 insofar as the spacer 32 are concerned are not true sections but have been modified to show in a single sectional view the passage 70, passage 82 and one of the dowel pins 76.

Figure 5:
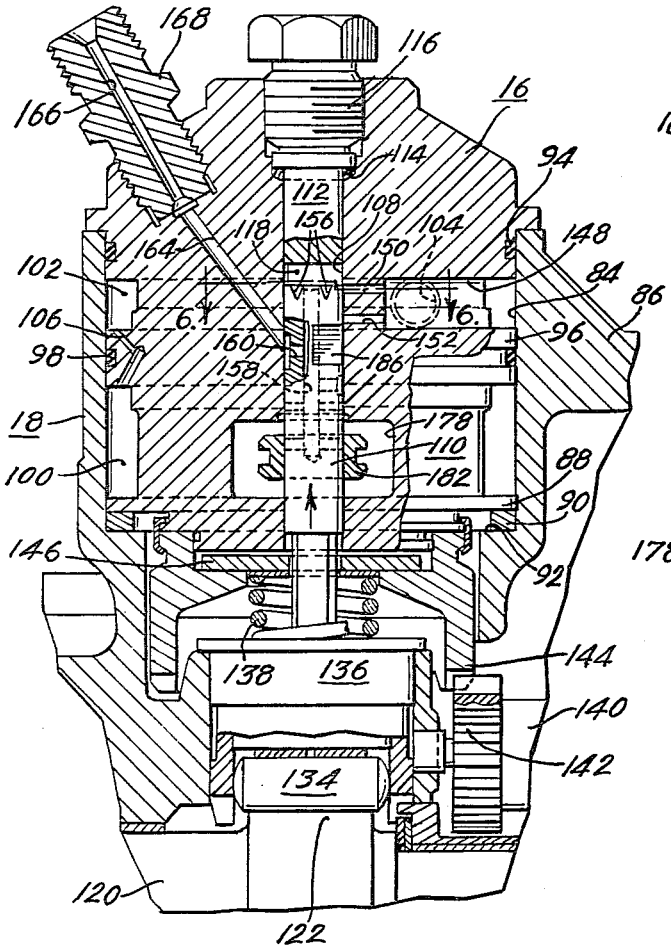
FIG. 5 is a sectional view taken along line 5—5 of FIG. 4 with the pump plunger shown during the fuel injection stroke.

The details of the hydraulic head are illustrated in FIGS. 4–13. With particular reference to FIG. 5, the hydraulic head 16 is seen to comprise a substantially cylindrical assemblage which is disposed within a vertical bore 84 of the fuel pump housing 86. The hydraulic head 16 is sealed within the bore 84 by means of a lower flange 88 thereof seated on a seal ring 90 disposed on shoulder 92 of the housing 86. The hydraulic head is sealed along its upper periphery by a seal ring 94. Between the flange 88 and the seal ring 94, the hydraulic head is set back from the bore 84 to establish an annular gallery between the hydraulic head body and the casing bore. An annular portion 96 of the hydraulic head, which is known as a gallery guard, is sealed to the bore 84 by seal ring 98, and divides the gallery into a lower gallery 100 and an upper gallery 102. Fuel to be pumped is delivered under a relatively low pressure, for example 20 to 30 psi, into the upper gallery 102 through an inlet port 104, the upper gallery constituting a fuel supply chamber. The low pressure fuel is supplied from an engine driven gear pump and is delivered to the hydraulic head after passing through several filtration stages. Although the lower gallery 100 is sealed from the upper gallery 102 by the gallery guard 96, fluid communication is provided between the lower and upper galleries by a bleed passage 106 which serves an important function as described herebelow.

The hydraulic head 16 includes a central vertical bore 108 within which a pumping and distributing plunger 110 is slidably and rotatably disposed. The bore 108, which passes completely through the hydraulic head 16, is closed at its upper end by a plug 112 sealed therein by seal ring 114 and secured by the screw 116. A fuel pumping chamber 118 is formed within the bore 108 between the top of the plunger 110 and the plug 112.

The plunger 110 is actuated by a camshaft 120 driven by the engine on which the pump is mounted. The camshaft includes a cam 122 which engages a roller 134 of tappet 136 abutting the lower end of the plunger. Compression spring 138 holds the plunger and tappet against the cam. The rotation of the camshaft 120 will accordingly produce a reciprocatory movement of the plunger 110 by means of the cooperation of the cam 122, tappet 136 and spring 138.

The rotation of the plunger 110 is also produced by the rotating camshaft 120 which is geared to a governor shaft 140. A gear 142 on the camshaft 140 meshes with a face gear 144 having a hub portion 146 which is slidably keyed to the lower end of the plunger to produce rotation of the plunger while permitting a reciprocatory movement of the plunger with respect thereto.

Since the present pump is designed to supply fuel to a six cylinder engine, there will be six axial pumping strokes of the plunger 110 for each plunger revolution. The plunger will accordingly rotate 60° during each pumping cycle.

Figure 6:
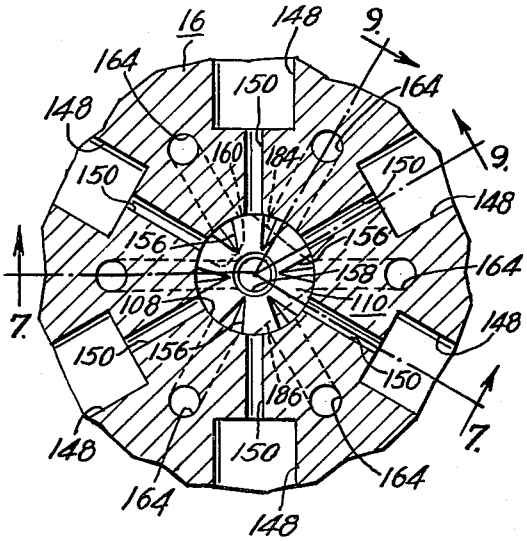
FIG. 6 is an enlarged sectional view taken along line 6—6 of FIG. 5.
Figure 10:
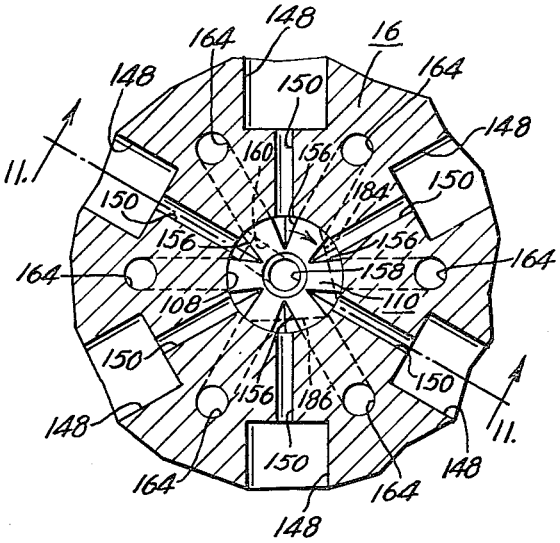
FIG. 10 is a view similar to FIG. 6 but with the pump plunger shown during the suction stroke.
Figure 11:
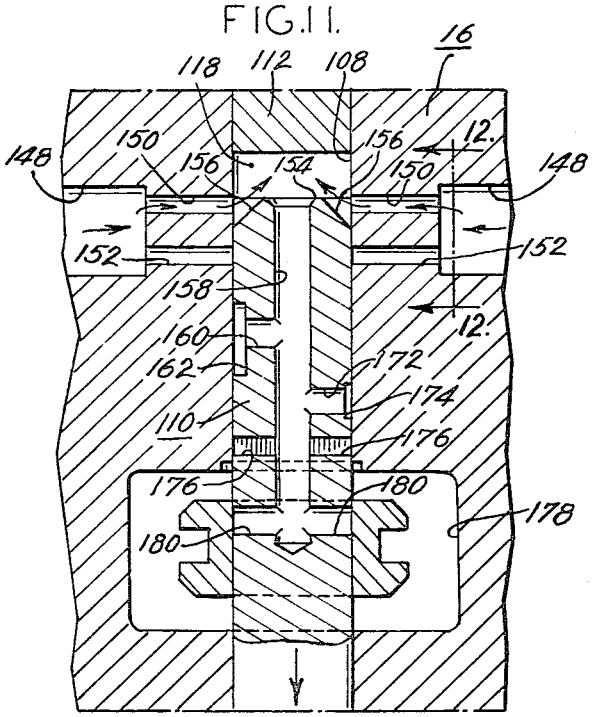
FIG. 11 is a sectional view taken along line 11—11 of FIG. 10 showing the fuel flow from the fuel supply ports into the pumping chamber.
Figure 12:
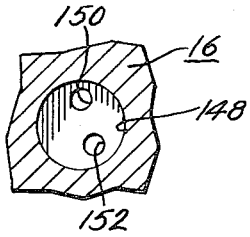
FIG. 12 is a sectional view taken along line 12—12 of FIG. 11 showing the arrangement of the fuel supply ports.
Figure 13:
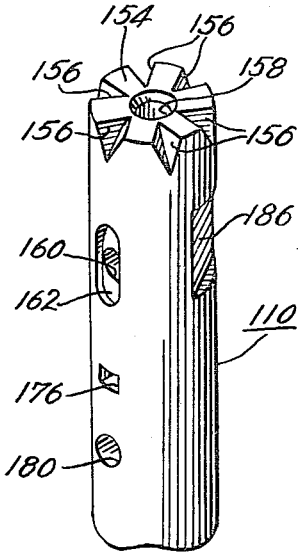
FIG. 13 is a partial isometric view of the pump plunger.

The low pressure fuel passes from the upper gallery 102 (fuel supply chamber) into the pumping chamber 118 during the suction stroke of the plunger 110 through radial fuel passages 148 and upper and lower fuel ports 150 extending between the fuel passages 148 and the bore 108. In order to permit entry of fuel from the ports 150 into the pumping chamber 118 before the upper end 154 of the plunger has cleared the upper ports 150 on the downstroke of the plunger, notches 156 are provided in the edge of the plunger at 60° intervals. The notches are located so as to open the pumping chamber to the upper ports 150 during the downstroke of the plunger but to rotate out-of-phase with the ports 150 during the upstroke of the plunger. As shown in FIGS. 6 and 10, there are six fuel passages 148 and six pairs of fuel ports 150 and 152, which are spaced at 60° intervals. As shown in FIGS. 10 and 11, during the plunger downstroke (suction stroke) the notches 156 are rotated into alignment with the ports 150 so that fluid communication is provided simultaneously between all six of the passages 148 and the pumping chamber 118. During the plunger upstroke (compression or pumping stroke), the notches are rotated out of alignment with the ports as shown in FIG. 6.

Figure 7:
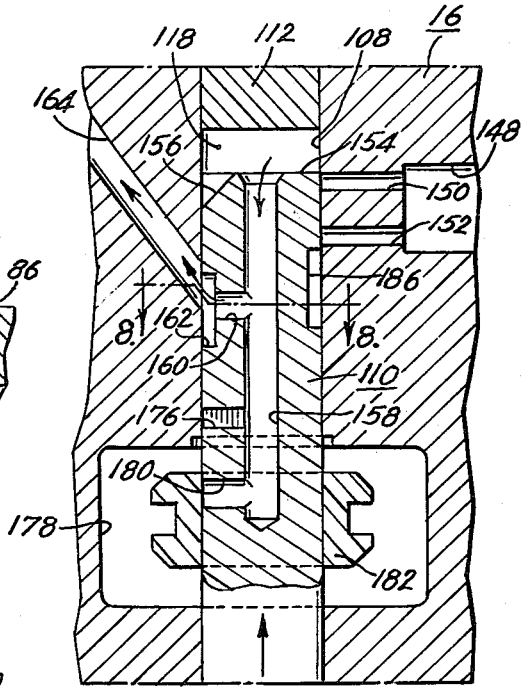
FIG. 7 is a sectional view taken along line 7—7 of FIG. 6.
Figure 8:
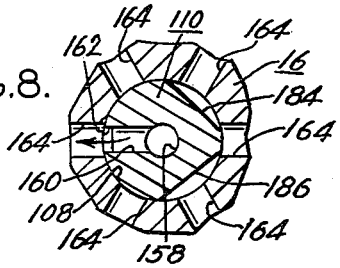
FIG. 8 is a sectional view taken along line 8—8 of FIG. 7.

The plunger 110 includes a coaxial bore 158 opening into the pumping chamber 118 at its upper end. A delivery port 160 communicating with the bore 158 opens into a distributor slot 162 which sequentially communicates with fuel outlet passages 164 during the upstroke (pumping stroke) of the plunger as illustrated in FIGS. 7 and 8. There are six outlet passages 164 spaced at 60° intervals and as shown in FIGS. 5 and 6, each of the outlet passages 164 communicates with a central passage 166 of a threaded connector 168 threadedly attached to the hydraulic head. As shown in FIG. 1, the injection line 20 is attached to the connector 168 by means of a nut 170.

As shown in FIG. 11, a plunger balancing port 172 and slot 174 are diametrically opposed from the port 160 and distributor slot 162 to expose the bore 108 to the high pumping pressure within the plunger bore 158 during the injection interval. The slot 174 is of the same area as the slot 162 to provide a balancing of the high pressure forces and prevent binding of the plunger.

Auxiliary fill ports 176 are provided in the plunger which open into a spill sump 178 when the plunger is in the lower part of its filling cycle. The spill sump 178 comprises a transverse chamber extending through the hydraulic head and opening into the lower gallery 100, the spill sump and lower gallery together defining a spill chamber.

Transverse spill ports 180 in the plunger communicating with the plunger bore 158 open into the spill sump 178. A fuel control sleeve 182 slidably disposed on the plunger within the spill sump 178 is positioned by a linkage (not shown) from the governor and covers the spill ports 180 during injection. When the spill ports 180 clear the upper edge of the control sleeve 182, the high fuel pressure in the pumping chamber 118 and plunger bore 158 is dropped to the pressure within the spill chamber, thereby cutting off injection. The higher the position of the fuel control sleeve 182 in the spill sump 178, the later in the pumping stroke the spill ports 180 will open into the spill sump, and hence the greater the quantity of fuel injected.

Figure 9:
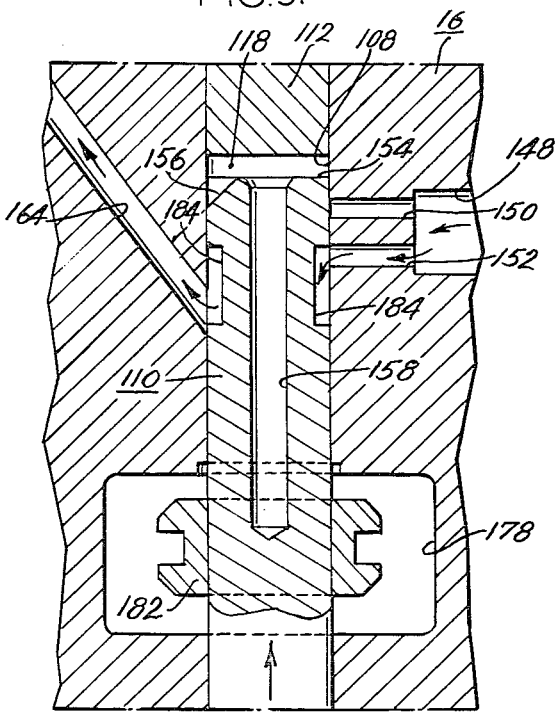
FIG. 9 is a sectional view taken along line 9—9 of FIG. 6 illustrating the fuel path for injection line fill.

Since the fuel pump disclosed does not utilize a delivery valve, means are provided to maintain a uniform residual pressure in each fuel outlet passage 164 and delivery line 20 as well as the fuel passages connected therewith within the nozzle holder and nozzle, which line and passages collectively are referred to as a fuel distribution passage. This means comprises means for placing the fuel distribution passages in communication with the low pressure fuel in the upper gallery between injection intervals. A pair of flats 184 and 186 on the plunger are disposed on the opposite side thereof from the distributor slot 162 and axially extend so as to place the lower fuel inlet ports 152 in communication with certain of the idle fuel outlet passages 164 as shown in FIGS. 8 and 9. This arrangement insures a predetermined pressure in the fuel distribution passages so that the fuel delivery through the passages to each nozzle will be both uniform and predictable.

Figure 14:
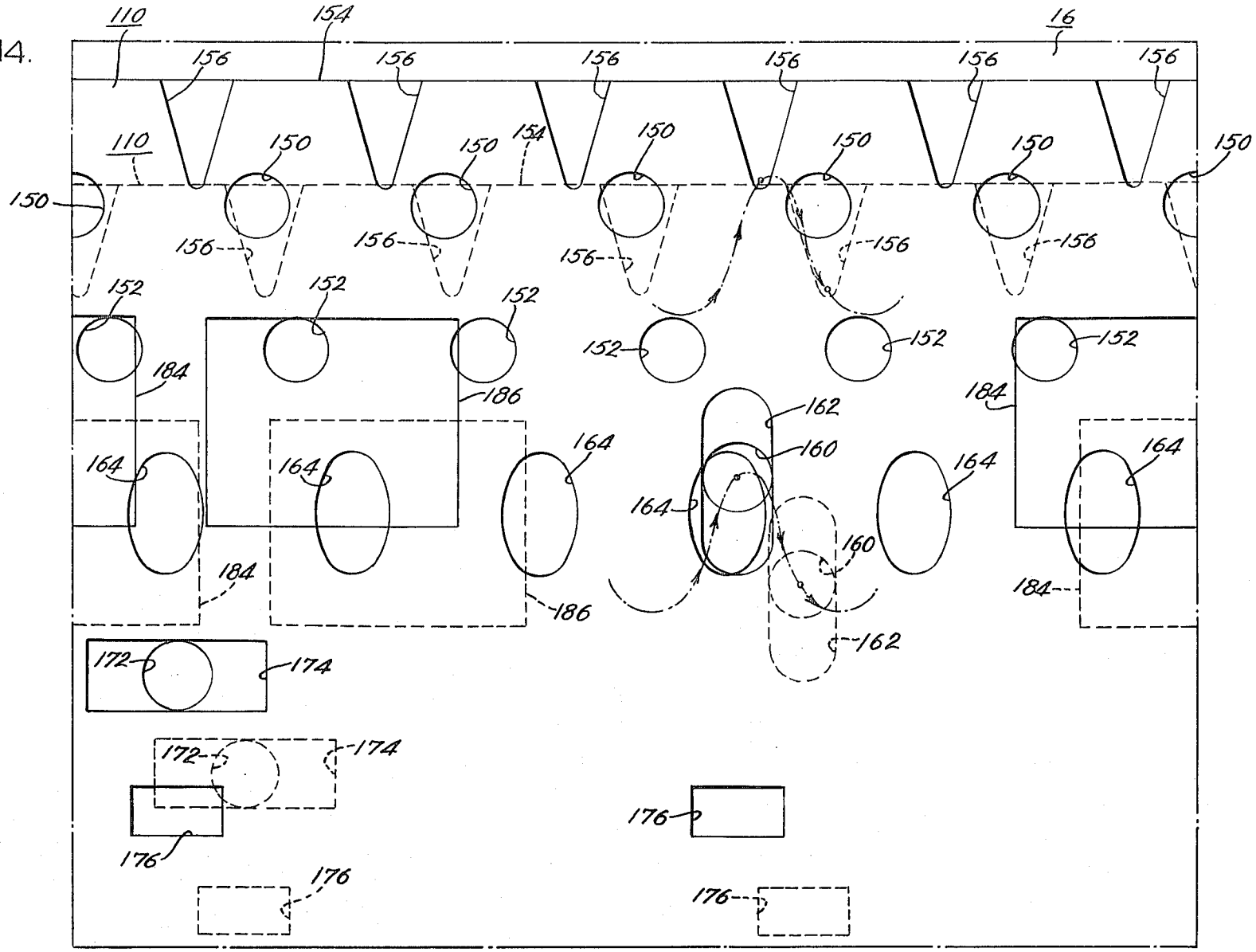
FIG. 14 is an enlarged development view showing the pump plunger and cylinder surfaces superimposed and illustrating the path of the plunger elements along the cylinder surface.

In operation, during the pumping stroke of the plunger as shown in FIG. 6, and the development view of FIG. 14, the plunger is rotationally disposed so that the plunger notches 156 lie between the fuel inlet ports 150 while the distributor slot 162 communicates with one of the outlet passages 164 to direct high pressure fuel thereinto as shown in FIG. 7. At the same time, as shown in FIGS. 8, 9 and 14, the flats 184 and 186 of the plunger are connecting certain of the lower fuel ports 152 with three of the idle outlet passages 164 to produce a uniform fuel pressure in these passages.

Injection is terminated when the spill port 180 of the plunger clears the upper edge of the spill sleeve 182, at which point the high pressure fuel in the fuel distribution passages as well as the plunger passages and pumping chamber is released to the spill chamber. Since the spill chamber is sealed except for the bleed passage 106, the spill chamber pressure will build up momentarily upon fuel cutoff to restrict the fuel flow from the distribution passages, thereby minimizing the opportunity for voids to form in the passages. The bleed passage 106, which in a preferred embodiment of the invention has a diameter of only 0.030 inches, prevents the average pressure in the spill chamber from becoming unduly high. In a preferred embodiment of the invention, the average pressure in the spill chamber is approximately 300–400 psi. Because of the cyclical nature of the pump operation, the pressure in the spill chamber will also be cyclical, peaking just after fuel cutoff. The present invention is particularly effective during low speed operation when longer time periods between injection intervals would otherwise permit more fuel flow from the distribution passages.

During the suction stroke of the plunger, as shown in FIGS. 11 and in the dotted line position of the plunger in FIG. 14, the notches 156 of the plunger communicate with the upper fuel ports 150 to permit a filling of the fuel injection chamber even before the top of the plunger clears the upper edge of the ports 150. The flats 184 and 186 as shown in FIG. 14 are no longer in communication with the lower fuel ports 152 although they continue to communicate with certain of the outlet passages 164. The distributor slot 162 as also shown in FIG. 14 has passed out of communication with one of the outlet passages 164 and is on its way to the next passage through which fuel will be distributed.

Since the use of an annular fuel supply gallery surrounding the central portion of a pump hydraulic head is a feature common to several commercially popular single plunger pump embodiments, the particular embodiment of the present invention disclosed including the gallery guard feature with the bleed passage therein can be appreciated as a relatively simple modification of a conventional pump design for producing the necessary separate spill and fuel supply chambers with a bleed passage therebetween. Although the spill chamber bleed passage could communicate with another low pressure fuel sump other than the pump fuel supply chamber, it will be apparent that the proximity of the fuel supply chamber and the need therein of a pressurized fuel makes the fuel supply chamber the obvious choice for achieving pressure relief in the spill chamber.

The reduction of the fuel distribution passage pressure between injection intervals to a level of several hundred pounds per square inch from a peak pressure normally in excess of 10,000 psi, permits the fuel leaking into the spring chamber of the leakless nozzle to leak back out into the injection passages, thereby preventing a buildup of pressure in the spring chamber which might interfere with the proper lifting of the nozzle valve. The use of a leakless nozzle of this type is not only desirable due to the elimination of the usual leakoff fittings, but further because of the spring chamber which is lower at low loads and low speeds resulting in a desirable reduction of nozzle opening and closing pressures under these conditions.

Manifestly, changes in details of construction can be effected by those skilled in the art without departing from the spirit and scope of the present invention.

We claim:

1. A fuel injection pump comprising a hydraulic head having a bore therein, a fuel pumping plunger slidably disposed in said bore and defining a fuel pumping chamber therewithin in conjunction with a closed end of said bore, means for reciprocating said plunger within said bore to produce pumping and suction strokes of said plunger, fuel supply means for supplying fuel to said pumping chamber during the suction strokes of said plunger, a valveless fuel distribution passage communicating with said bore, passage means in said plunger for delivering high pressure fuel from said pumping chamber to said fuel distribution passage during pumping strokes of said plunger, a spill chamber in said hydraulic head adjacent said plunger, passage means in said plunger connecting said pumping chamber with said spill chamber upon termination of fuel injection, a low pressure fuel chamber, and restricted passage means connecting said spill chamber with said low pressure fuel chamber for producing a pressure buildup in said spill chamber and a restricted drainage of said fuel distribution passage upon injection termination.

2. A fuel injection pump for a multi-cylinder internal combustion engine comprising a hydraulic head having a bore therein, a pumping and distributing plunger rotatably and slidably disposed within said bore and defining a fuel pumping chamber therewithin in conjunction with a closed end of said bore, plunger drive means for driving said plunger in rotation and reciprocation, a fuel supply chamber, means for supplying fuel to said fuel supply chamber at a relatively low predetermined pressure, passage means connecting said fuel supply chamber with said fuel pumping chamber during the suction stroke of said plunger, a plurality of valveless fuel distribution passages communicating with said bore at equally spaced intervals, passage means within said plunger for sequentially connecting said fuel distribution passages with said pumping chamber during pumping strokes of said plunger to deliver high pressure fuel from said pumping chamber into said distribution passages, a spill chamber in said hydraulic head adjacent said plunger, passage means in said plunger connecting said pumping chamber and said fuel distribution passages with said spill chamber upon termination of injection, and restricted passage means connecting said spill chamber with said fuel supply chamber for producing a pressure buildup in said spill chamber and a restricted drainage of said fuel distribution passages upon injection termination.

3. The invention as claimed in claim 2 including passage means in said plunger for sequentially connecting said fuel distribution passages with said fuel supply chamber between connections thereof with said fuel pumping chamber to maintain a predetermined uniform residual fuel pressure in said fuel distribution passages.

4. A fuel injection pump for a multi-cylinder internal combustion engine comprising a pump housing, a generally cylindrical hydraulic head disposed within a bore in said pump housing, an annular gallery between said housing bore and said hydraulic head intermediate the ends thereof, means dividing said gallery into an upper gallery and a lower gallery, means for supplying fuel to said upper gallery at a relatively low predetermined pressure, a bore in said hydraulic head, a pumping and distributing plunger rotatably and slidably disposed within said bore and defining a fuel pumping chamber therewithin in conjunction with a closed end of said bore, plunger drive means for driving said plunger in rotation and reciprocation, passage means connecting said upper gallery with said fuel pumping chamber during the suction stroke of said plunger, a plurality of valveless fuel distribution passages communicating with said hydraulic head bore at equally spaced intervals, passage means within said plunger for sequentially connecting said fuel distribution passages with said pumping chamber during pumping strokes of said plunger to deliver high pressure fuel from said pumping chamber into said distribution passages, a spill sump in said hydraulic head adjacent said plunger, passage means including a spill port in said plunger connecting said pumping chamber and said fuel distribution passages with said spill sump, an adjustable control sleeve slidably disposed on said plunger and cooperating with said spill port to control timing of the termination of injection, said spill sump communicating with said lower gallery and forming therewith a spill chamber, and restricted passage means connecting said spill chamber with said upper gallery for producing a pressure buildup in said spill chamber and a restricted drainage of said fuel distribution passages upon injection termination.

5. The invention as claimed in claim 4 including passage means in said plunger for sequentially connecting said fuel distribution passages with said upper gallery between connections thereof with said fuel pumping chamber to maintain a predetermined uniform residual fuel pressure in said fuel distribution passages.

6. The invention as claimed in claim 4 wherein said means dividing said gallery into an upper gallery and lower gallery comprises an annular portion of said hydraulic head, and wherein said restricted passage means comprises a bleed passage through said annular portion.

7. The invention as claimed in claim 4 wherein said plunger passage means for sequentially connecting said fuel distribution passages with said pumping chamber comprises a central axial bore in said plunger opening at one end into said pumping chamber, and a delivery port connecting said plunger bore with a distributor slot in the side of said plunger.

8. The invention as claimed in claim 7 wherein said passage means in said plunger connecting said pumping chamber and said fuel distribution passages with said spill sump comprises a continuation of said plunger bore extending below said delivery port and terminating adjacent and in communication with said spill port.

* * * * *